United States Patent [19]

Boyadjieff

[11] Patent Number: 4,765,401

[45] **Date of Patent: * Aug. 23, 1988**

[54] APPARATUS FOR HANDLING WELL PIPE

[75] Inventor: George I. Boyadjieff, Anaheim, Calif.

[73] Assignee: Varco International, Inc., Orange, Calif.

[ * ] Notice: The portion of the term of this patent subsequent to Sep. 29, 2004 has been disclaimed.

[21] Appl. No.: 898,719

[22] Filed: Aug. 21, 1986

[51] Int. Cl.[4] ..... E21B 19/20

[52] U.S. Cl. ..... 166/77.5; 81/57.34; 175/52; 175/85; 414/22

[58] Field of Search ..... 175/52, 85; 166/77.5; 414/22, 745, 917; 211/70.4; 81/57.34

[56] References Cited

U.S. PATENT DOCUMENTS

| | | | |
|---|---|---|---|
| 2,737,839 | 3/1956 | Paget | 81/57.34 |
| 3,921,823 | 11/1975 | Bourree et al. | 414/22 |
| 4,069,879 | 1/1978 | Brown et al. | 175/85 X |
| 4,267,675 | 5/1981 | Cochran | 414/22 X |
| 4,345,864 | 8/1982 | Smith, Jr. et al. | 414/22 |
| 4,348,920 | 9/1982 | Boyadjieff | 166/77.5 X |
| 4,497,996 | 2/1985 | Libby, Jr. et al. | 901/47 X |
| 4,548,544 | 10/1985 | Van Appledorn | 414/917 X |
| 4,610,315 | 9/1986 | Koga et al. | 175/85 |
| 4,696,207 | 9/1987 | Boyadjieff | 414/22 X |

FOREIGN PATENT DOCUMENTS

| | | | |
|---|---|---|---|
| 2160564 | 12/1985 | United Kingdom | 175/85 |
| 0894175 | 12/1981 | U.S.S.R. | 175/85 |

*Primary Examiner*—George A. Suchfield
*Assistant Examiner*—David J. Bagnell
*Attorney, Agent, or Firm*—William P. Green

[57] ABSTRACT

A well pipe handling machine including a vertically extending column structure which carries means for engaging and holding a pipe in vertical condition and is movable with the pipe holding means between a first position in which a carried pipe can be connected to and disconnected from the upper end of a drill string and a laterally offset second position for storing pipe in a rack at a side of the well. The pipe holding means may include a parallelogram mechanism having two arms carrying two vertically spaced pipe holding units and adapted to swing in unison to move the units toward and away from the column structure. The column desirably also carries pipe rotating means including a torque wrench and a spinner for making and breaking a threaded connection between a section of pipe and the string. The spinner is mounted for shifting movement upwardly and downwardly relative to the pipe holding means, and preferably is positioned at the lower end of an operator's cab which is also carried by the support column structure for movement therewith between its different positions. The torque wrench may be located beneath the spinner at the lower end of the control station, and is movable upwardly and downwardly with the spinner and cab relative to the pipe holding means.

24 Claims, 9 Drawing Sheets

29
28
17
27
26
4
4
25
36
35
11
20
31
31'
12
20
10
37
35
16
41
40
30
15
14
160
13
19
18

22
53
6
52
35
23
36
53
31
55
102
54
37
10
40
44
59
41
21
6
13

FIG 4
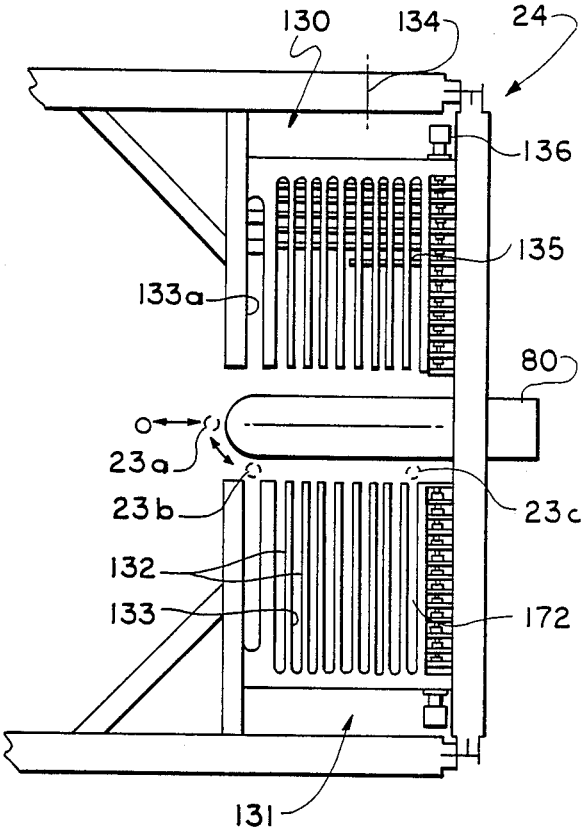
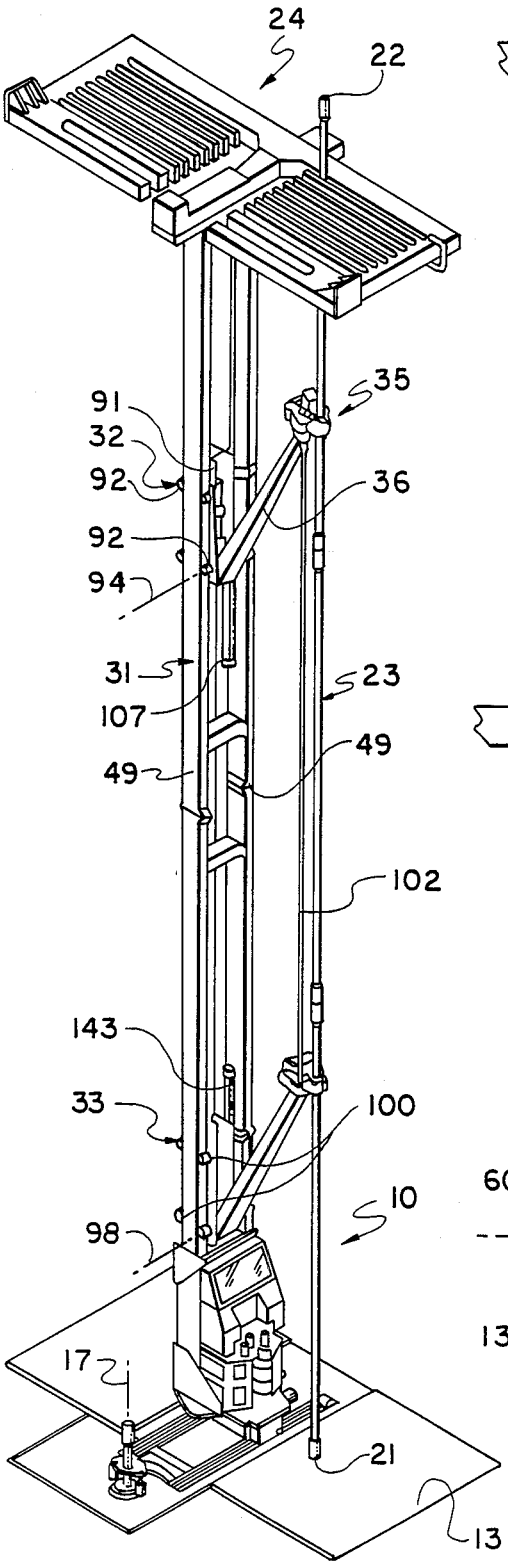
FIG. 3
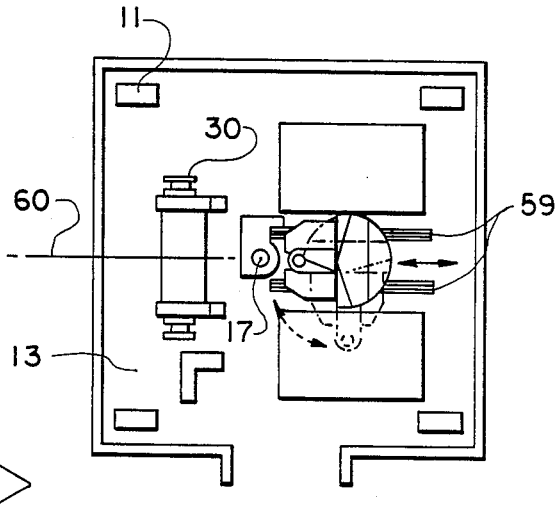
FIG. 5

24
48
82
87
81
80
85
83
52
89
90
50
86
88
45
84
135
151
38
104
8
103
102
152
9
101
39
105
203
49
36
102
7
32
96
91
95
94
98
93
103
97
37
143
33
99
94'
140
40
147
217
216
214
212
220
218
219
146
215
213
41
42
34
43
48
51
46
16
70
76
72
13
59
47
78
77

FIG. 14
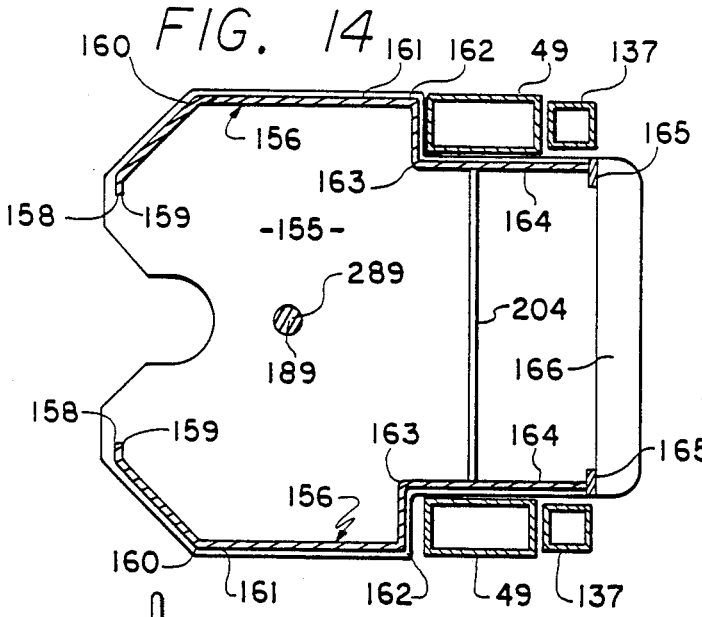
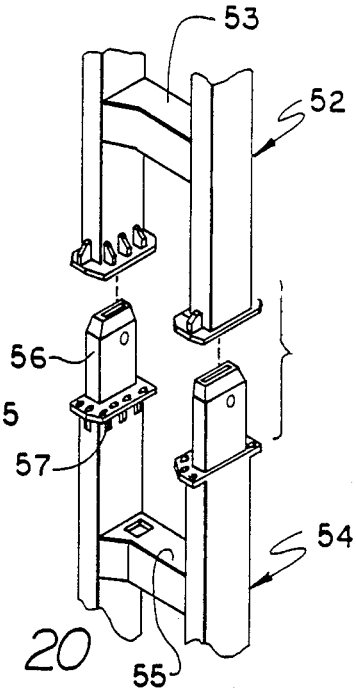
FIG. 20
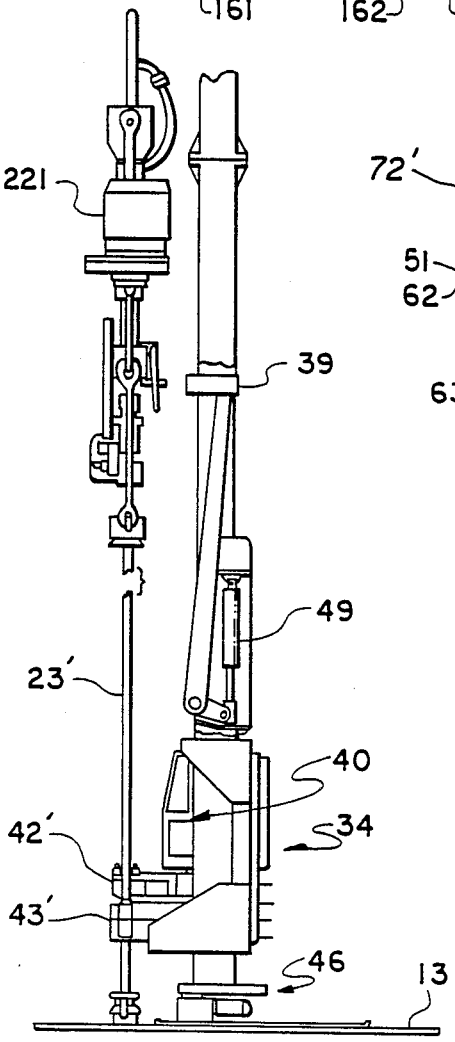
FIG. 18
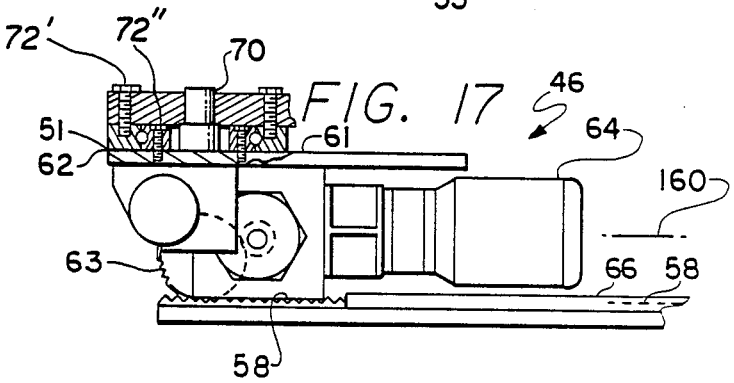
FIG. 17
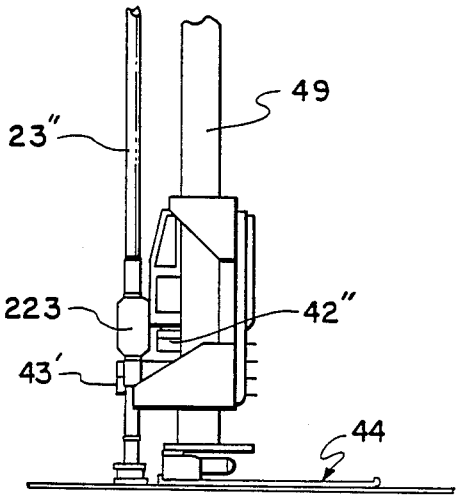
FIG. 19

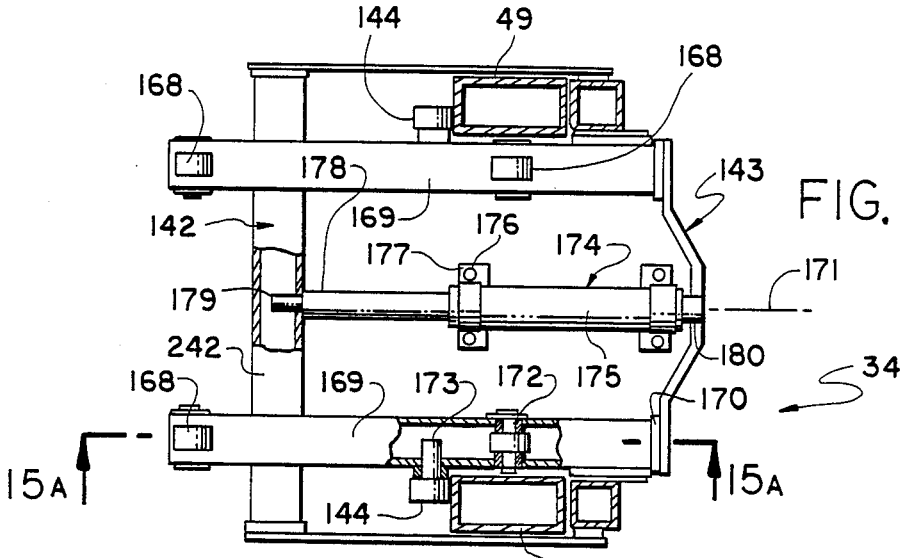
FIG. 15
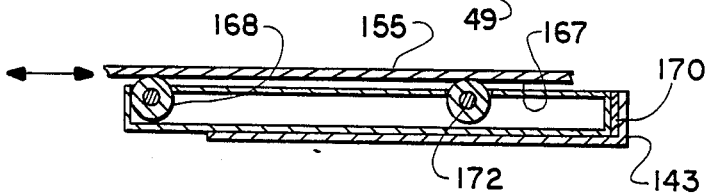
FIG. 15A
FIG. 16
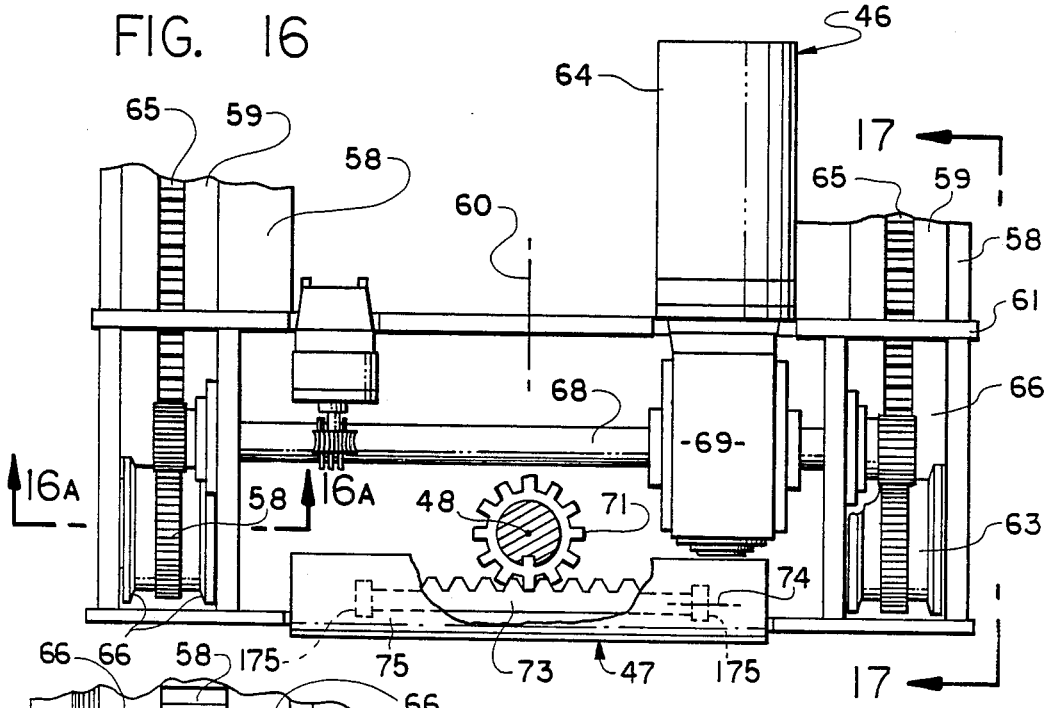
FIG. 16A

APPARATUS FOR HANDLING WELL PIPE

BACKGROUND OF THE INVENTION

This invention relates to apparatus for use in a well rig to assist in connecting pipe stands to or disconnecting them from a string of pipe.

In my copending U.S. patent application Ser. No. 6/727,724 filed Apr. 26, 1985, now U.S. Pat. No. 4,709,766, on "Well Pipe Handling Machine", I have disclosed a machine including a vertical column which carries means for holding a section of well pipe in vertical condition, and which is power actuable between a position adjacent to the well axis for holding a pipe in alignment with the axis and a laterally offset position in which the pipe remains vertical and can be placed in a storage rack in a side of the rig. The pipe holding means may include a parallelogram mechanism having two arms carrying two vertically spaced pipe holding units and adapted to swing in unison to move the pipe toward and away from the vertically extending column structure. The machine of that prior application also includes pipe rotating or connecting means, desirably consisting of a torque wrench and a spinner which are movable with the column between its two specified positions and are shiftable upwardly and downwardly relative to the column structure with the pipe holding means and with a control station adapted to carry an operator. The torque wrench and control station of that prior arrangement are also shiftable upwardly and downwardly relative to the spinner and pipe holding means.

SUMMARY OF THE INVENTION

The present invention provides certain improvements for enhancing the operation and versatility of a machine such as that shown in the above identified prior application. For example, in a machine embodying this invention the spinner is desirably located at essentially the lower end of the control station rather than near its upper end as in the prior application. The spinner may be closely proximate and directly above the torque wrench, with both being easily viewed by an operator located in the control station. The spinner is desirably shiftable upwardly and downwardly relative to the main support column and the pipe holding means, and with the torque wrench and control station, so that all of these units can be easily and quickly adjusted to a proper level for engaging a threaded connection to be made or broken by the equipment.

Certain additional features of the invention relate to the preferred mounting of the pipe rotating or connecting apparatus, desirably including a torque wrench and spinner, for movement generally horizontally relative to the support column structure and the pipe holding means between an inner position for engaging and turning vertical pipes at a location closely proximate the column and an outer position spaced farther from the column. The torque wrench and spinner in their inner position can then be utilized for making and breaking connections between the upper end of a well pipe string and a pipe stand consisting of several interconnected lengths of pipe, and in the outer position can be utilized for handling single lengths of pipe to be connected to or disconnected from the well string. In addition, the spinner is preferably power actuable horizontally relative to the torque wrench, to retract the spinner to a position enabling the torque wrench to engage and act on a joint independently of the spinner when the apparatus is handling a well collar or stabilizer having a diameter or configuration with which the spinner cannot be used.

BRIEF DESCRIPTION OF THE DRAWINGS

The above and other features and objects of the invention will be better understood from the following detailed description of the typical embodiment illustrated in the accompanying drawings, in which:

FIG. 3 shows the machine of FIG. 1 in a retracted position away from the well axis for locating a stand of drill pipe in a stored position within a racking board;

FIG. 4 is an enlarged fragmentary plan view of the pipe racking board taken on line 4—4 of FIG. 1;

FIG. 5 is a somewhat diagrammatic representation of the rig floor, taken on line 5—5 of FIG. 1, with the full line position of FIG. 5 corresponding to the broken line position of FIG. 1;

FIGS. 11, 12, 13, 14 and 15 are horizontal sections taken on lines 11—11, 12—12, 13—13, 14—14 and 15—15 respectively of FIG. 6A, and showing the pipe connecting and disconnecting assembly of the machine at different levels;

FIG. 15A is a fragmentary vertical section taken on line 15A—15A of FIG. 15;

FIG. 16 is a horizontal section taken primarily on line 16—16 of FIG. 6, and showing the column pivoting unit;

FIG. 16A is an enlarged fragmentary vertical section taken primarily on line 16A—16A of FIG. 16;

FIG. 17 is a view taken primarily on line 17—17 of FIG. 16 and partially broken away;

FIG. 18 is a view similar to a lower portion of FIG. 1, but showing the column and carried apparatus retracted slightly away from the well axis, with the torque wrench and spinner shifted outwardly relative to the column for use in connecting and disconnecting a single length of pipe rather than a three length stand; and FIG. 19 is a view similar to a lower portion of FIG. 1, but showing spinner retracted to enable use of the torque wrench to make and break a connection between two lengths of drill collar, and/or where increased diameter stabilizers are provided in the string adjacent the joint being made or broken.

DESCRIPTION OF THE PREFERRED EMBODIMENTS

Figure 1:
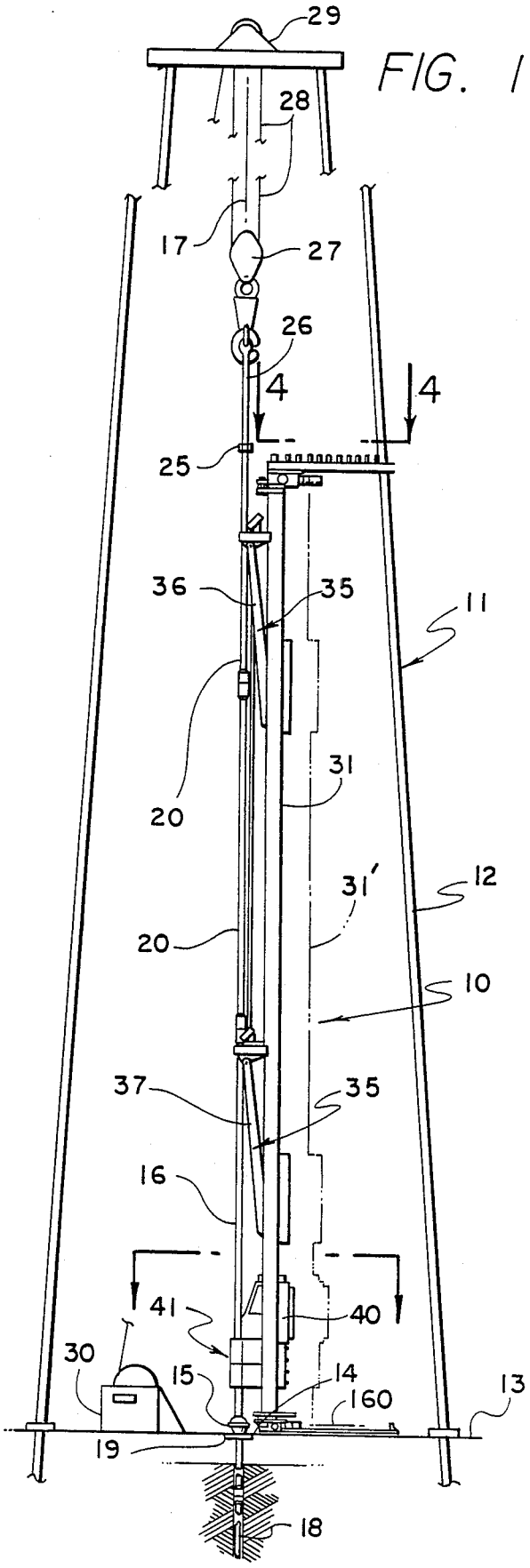
FIG. 1 is a side view of a pipe handling machine for a well rig embodying the invention, shown in a position of engagement with the upper end of a drill string.

FIG. 1 illustrates a well pipe handling machine 10 embodying the invention positioned within a well drilling rig 11 having a derrick 12 with a rig floor 13 containing an opening 14 within which a slip assembly 15 is removably receivable to releasably support a drill string 16 extending along a vertical axis 17 and downwardly into a well 18. The rig typically illustrated in the drawings is a conventional arrangement including a rotary table 19 within which the slip supporting opening 14 is formed and which is power driven rotatably about axis 17 to turn the string and carried bit during a drilling operation. Alternatively, the machine of the present invention may also be utilized in a top drive drilling system, including a motor connected to the upper end of the drill string and driving it rotatively and which moves upwardly and downwardly with the string during drilling. The drill string 16 includes a series of pipe sections 20 each having a lower externally threaded pin end 21 and an upper internally threaded box end 22 enabling the pipe sections to be connected threadedly together to form a drill string of any desired length. When it becomes necessary to remove the string from the well for any reason, as for instance to replace or repair the bit, the string is broken into a series of stands 23 (FIG. 3) each including three of the interconnected pipe sections 20, and these stands are moved by the machine 10 from the center line position of alignment with axis 17 of the well to storage positions within a racking board assembly 24. After the bit has been replaced or other desired operation has been performed, the round trip of the string is completed by successively moving the various stands 23 from the racking board back to the well axis and progressively lowering the string into the well. During this round trip operation, the pipe string is raised and lowered by a remotely controlled elevator 25 suspended by links 26 from a travelling block 27, which in turn is suspended on a line 28 from a crown block 29 attached to the top of the derrick, with the line being actuable by conventional drawworks 30 to move the elevator upwardly and downwardly.

Figure 6:
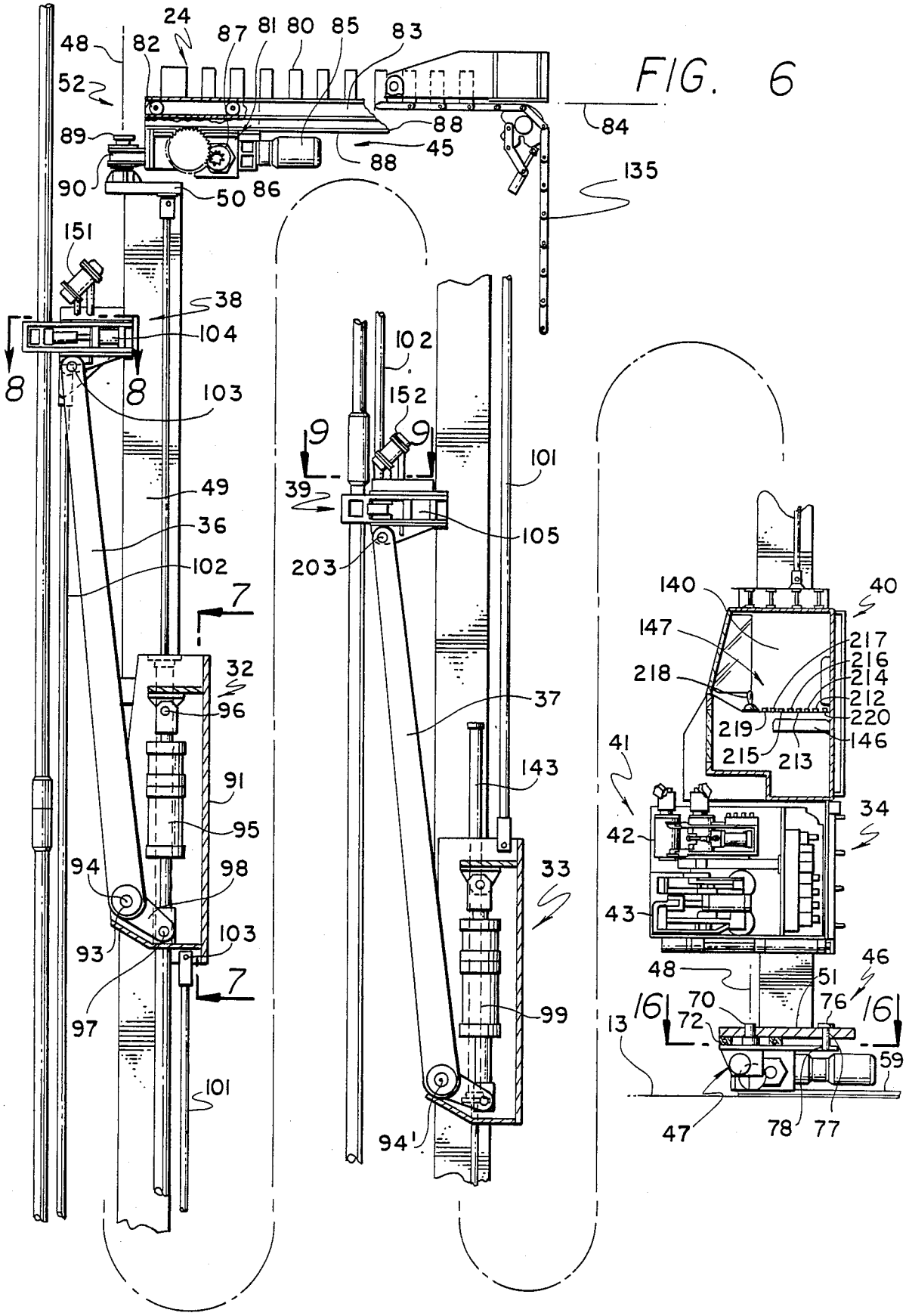
FIG. 6 is an enlarged vertical section through the pipe handling machine taken on line 6—6 of FIG. 2.

The pipe handling portions of the machine are carried primarily by a vertical support column structure 31 which functions as a support and guide for three carriages 32, 33 and 34 (FIG. 6) guided for upward and downward movement along the column structure. Carriages 32 and 33 support a parallelogram mechanism 35 which includes two similar upper and lower arms 36 and 37 carrying upper and lower pipe holding or clamping units 38 and 39 respectively at the outer ends of the arms. The lower carriage 34 mounts a control cab or station 40 within which an operator of the machine is located, and beneath the cab carries a well pipe connecting and disconnecting assembly 41 including a spinner 42 for turning a pipe section rapidly, and a torque wrench 43 for turning at high torque an upper stand or section of pipe relative to the upper end of the drill string to make or break a connection between the upper stand and the drill string. The main vertically extending column structure 31 is movably supported at its lower end on a base 44 connected to rig floor 13, and is connected movably at its upper end to racking board 24. Two synchronized powered drives 45 and 46 (FIG. 6) move the upper and lower ends of the column structure and carried parts leftwardly and rightwardly in unison as viewed in FIG. 1, and a rotary drive 47 at the lower end of the column structure is operable to pivot the column structure and carried parts through 180° and about a vertical axis 48 parallel to axis 17.

Figure 2:
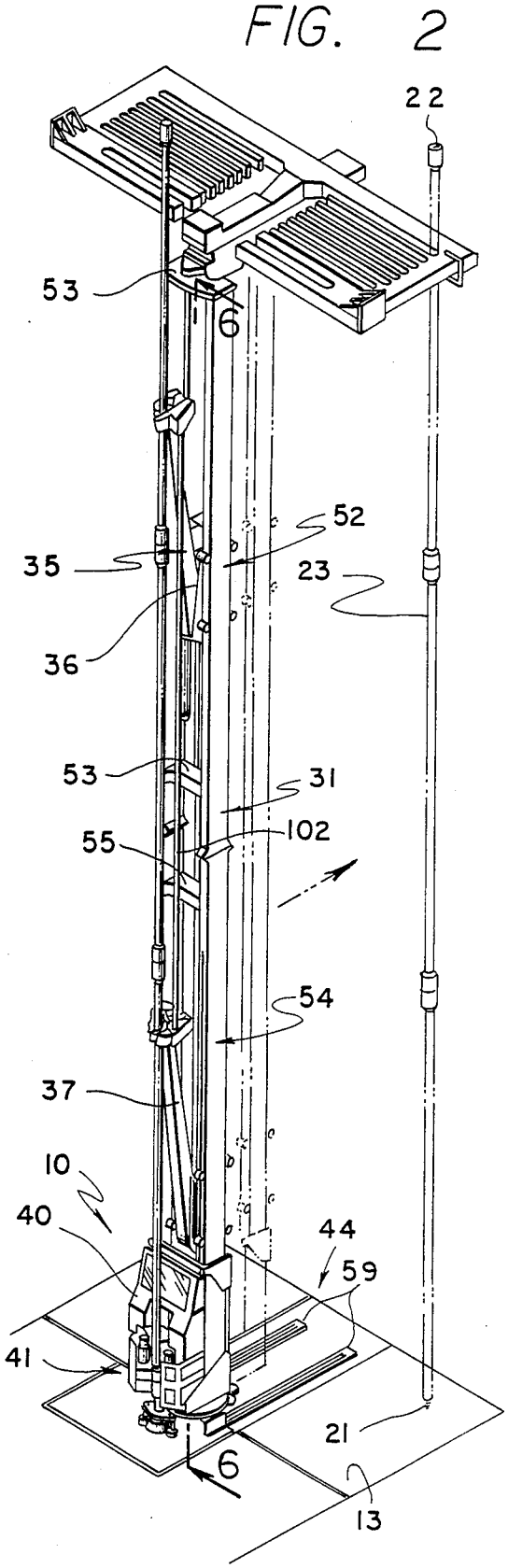
FIG. 2 is a perspective view of the pipe handling machine of FIG. 1.
Figure 11:
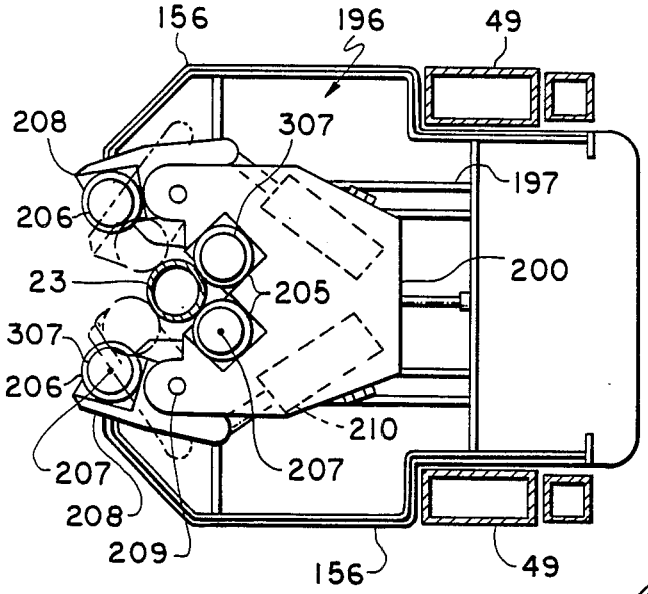
Figure 12:
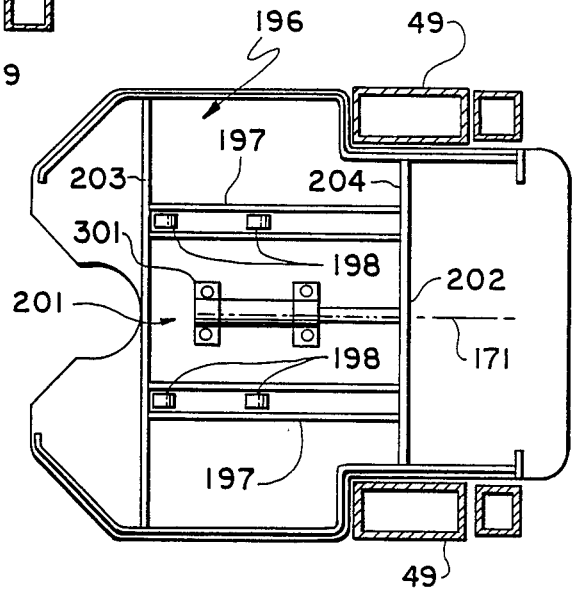

The main support column structure 31 is a rigid vertical framework including two similar spaced parallel vertical tracks or rails 49 joined together at their upper ends by a horizontal connector member 50 welded or otherwise secured to tracks 49, and secured together at their lower ends by a horizontal connector member 51 also appropriately rigidly secured to the tracks 49. The tracks may have the hollow rectangular horizontal sectional configuration illustrated in FIG. 11 and in others of the figures. To facilitate manufacture, transportation and assembly of the column structure, it is preferred that this structure be formed in two parts, including an upper section 52 (see FIG. 2) consisting of upper portions of the two tracks rigidly connected together by the upper crosspiece 50 and one or more additional horizontally extending crosspieces 53, and a similar lower section 54 consisting of lower portions of the two tracks joined together by the bottom crosspiece 51 and one or more additional horizontally extending crosspieces 55. As seen in FIG. 20 these two upper and lower sections of the column structure may be joined together by extension of upper projections 56 on the two tracks of lower column section 54 into the lower ends of the two tracks of upper column section 52 in telescopically engaging and closely fitting relation, with flanges 57 of the upper and lower sections being bolted together to integrate those sections into the single rigid vertically elongated column structure.

The base 44 on which column structure 31 is movably supported may take the form of two rigid tracks 59 extending horizontally along the upper surface of and supported by the rig floor 13 and appropriately secured thereto in fixed position as by welding, bolts, or otherwise. Tracks 59 are located at opposite sides of and are equi-distant from, and extend parallel to, a vertical plane 60 (FIGS. 5 and 16) which contains the main vertical axis 17 of the well and extends radially with respect to that axis. A carriage 61 of the lower drive mechanism 46 is guided by the tracks for movement along an axis 160 (FIGS. 1 and 17) which extends horizontally and lies within vertical plane 60 and intersects and is perpendicular to well axis 17. This carriage includes a rigid framework or body 62 of any convenient configuration, having a pair of wheels (FIG. 16) at its opposite sides supporting the carriage on tracks 59 and guided by the tracks for left to right movement of the carriage as viewed in FIGS. 1 and 6. The wheels 63 of the carriage are driven rotatively by an electric motor 64 supported by the carriage 61, and are formed as gears having teeth 58 engaging and meshing with the similarly dimensioned teeth of two horizontally extending racks 65 formed in central portions of tracks 59. The rack portions 65 of the two tracks may be recessed downwardly beneath the upper surfaces of the portions 66 of the tracks at opposite sides of the racks, so that those portions 66 and annular flanges 67 of the wheels retain the wheels effectively on the grooved rack areas and guide the carriage for only straight line horizontal movement along axis 160. The two wheels 63 may be connected rigidly to a common horizontally extending shaft 68 driven rotatively in either direction by motor 64 through a speed reduction gear assembly 69, which is preferably a worm gear transmission acting to inherently brake the wheels in any position to which they may be turned so long as the motor is not energized.

The lower end of column structure 31 is connected pivotally to carriage 61 by a pivot pin 70, which may be rigidly welded or otherwise secured to the bottom horizontal plate 51 of the column structure (FIG. 6) and project downwardly therefrom along vertical axis 48. Pin 70 is keyed at its lower end to a pinion gear 71 (FIG. 16), with the pin and the pinion gear being journalled for rotation about vertical axis 48 relative to the carriage 61 by a suitable bearing or bearings 72 (FIG. 6) carried by the frame 62 of carriage 61. A toothed rack 73 engages pinion 71 (FIG. 16) and is actuable along a horizontal axis 74 (FIG. 16) by one or more hydrualic piston and cylinder mechanisms represented at 75 to turn the pinion gear and connected column structure 31 about axis 48 in response to the delivery of pressure fluid to the piston and cylinder mechanisms. As seen in FIG. 16, there preferably are two of the piston and cylinder mechanisms at opposite ends of rack 73 having their pistons 175 connected to opposite ends of the rack to simultanously actuate the rack linearly in either of its opposite directions. The column structure can thus be moved pivotally about axis 48 by the hydraulic rotary rack and pinion actuator 73–75, and can be moved toward and away from the main axis of the well by motor 64. The weight of the column structure is supported, preferably entirely, by carriage 61. For this purpose, the previously mentioned bearing 72 is desirably constructed to function as both a thrust bearing and a radial bearing, acting to effectively support the entire load of the column structure and carried parts including a supported pipe stand, while also effectively centering the column structure for its pivotal movement about axis 48 relative to the carriage. The bearing may be a ball bearing having its outer race bolted at 72' to plate 51 and having its inner race bolted at 72" to framework 62 of carriage 61. The carriage structure and carried parts may be locked in the central rotary position of FIG. 1 by insertion of a cylindrical locking pin 76 (FIG. 6) downwardly through a vertical opening 77 in the bottom plate 51 of the column structure and through a registering opening 78 in the frame of carriage 61. In this FIG. 1 position, the various pipe holding and actuating elements 38, 39, 42 and 43 have their gripping portions in axial alignment with one another and all centered about the main vertical axis 17 of the well, to hold and drive a pipe extending vertically along that axis. Rotary actuator 47 consisting of pinion 71, rack 73, and hydraulic actuators 75 can turn the column through exactly 180°, that is 90° in either direction from the central FIG. 1 position, with the pivotal motion being positively limited by engagement of appropriate stop shoulders on the pivotally connected parts in those extreme 90° positions, to properly locate the pipe holding units for movement of a carried pipe into and out of storage locations in the racking board.

The upper end of column structure 31 is mounted and driven by a powered straight line drive mechanism 45 which is synchronized with the lower straight line drive 46 of the column structure, to move the upper and lower ends in unison at all times, and in this way positively maintain the column structure and a pipe held thereby continuously in directly vertical condition during transportation of the pipe between the well axis and the racking board locations. The drive structure 45 at the upper end of the column is mounted to the underside of a central portion 80 of racking board 24 (FIGS. 4 and 6), and preferably includes a carriage 81 having rollers or wheels 82 engaging two parallel tracks 83 connected rigidly to the underside of member 80, with the rollers and tracks guiding carriage 81 for only straight line movement along a horizontal axis 84 extending parallel to and spaced above and in vertical alignment with the axis 160 of longitudinal movement of bottom support carriage 61 along the tracks 59. The upper axis 84 thus extends radially with respect to and intersects the main vertical axis 17 of the well, as does axis 160. Carriage 81 carries a motor 85 driving two gears 86 through a worm gear speed reduction assembly 87, with the gears 86 engaging two spaced parallel toothed racks 88 rigidly attached to the underside of member 80 to advance carriage 81 horizontally in either direction along axis 84 in accordance with powered rotation of gears 86 in either direction by motor 85. The motor 85, gears 86, transmission 87 and racks 88 may be identical with the corresponding motor 64, gears 63, transmission 69 and racks 65 of the lower column drive, to shift the upper and lower ends of the column horizontally exactly in unison with one another in a synchronized relation maintaining the column structure at all times precisely vertical. Motors 64 and 85 are connected to a common source of electrical power, to be energized precisely in unison and thus always assure actuation of the upper and lower ends of the column structure in exact correspondence with one another.

To allow pivotal movement of the carriage structure about vertical axis 48 by the lower rotary drive 47, the upper end of the column structure is connected pivotally to carriage 81. This connection may be effected by providing the upper horizontal cross-piece 50 of the column structure with an upwardly projecting pivot pin 89 aligned vertically with the lower pivot pin 70 and its vertical axis 48 and projecting upwardly through and journalled by a bearing structure 90 carried by carriage 81, to thus journal pin 89 and the upper end of the column structure for rotation about axis 48 through the previously discussed 180° range of rotary movement of the column structure.

Figure 7:
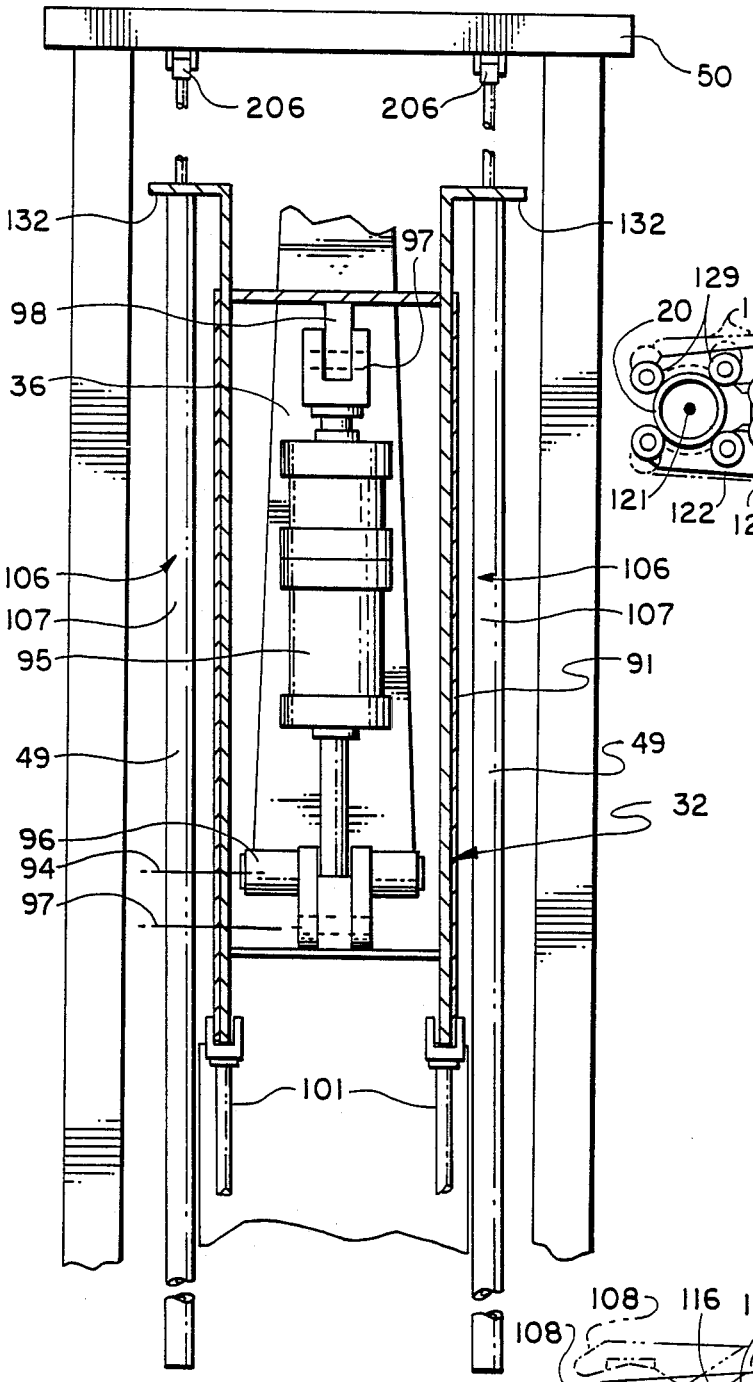
FIG. 7 is a fragmentary rear view of a portion of the machine near its upper end, taken on line 7—7 of FIG. 6.

The upper vertically movable carriage 32 has a body 91 which may be fabricated of a number of metal parts welded together to form a structure receivable between the two tracks 49 and carrying rollers 92 (FIG. 3) engageable with the front, rear and sides of tracks 49 to effectively guide the carriage for only up and down movement relative to and along column structure 31, and parallel to its vertical pivotal axis 48. Arm 36 is connected pivotally to carriage 32 at 93 for swinging movement relative to the carriage about a horizontal axis 94 between the FIG. 3 and FIG. 18 positions. The arm 36 is actuable between these positions by a piston and cylinder mechanism 95 (FIGS. 6 and 7), having its cylinder connected pivotally to body 91 of carriage 32 at 96, and having its piston connected pivotally at 97 to a short actuating arm 98 rigidly connected to the swinging arm 36. Hydraulic fluid may be supplied under pressure to either end of piston and cylinder mechanism 95, to positively swing arm 36 in either direction. The second arm 37 of the parallelogram mechanism is of a length corresponding to arm 36 and parallel thereto and is attached to carriage 33 in the same way that arm 36 is connected to carriage 32, and for pivotal movement relative to carriage 33 about an axis 94' parallel to axis 94 of arm 36. A second piston and cylinder mechanism 99 identical with the piston and cylinder mechanism 95 swings arm 37 relative to carriage 33 in unison with the swinging movement of arm 36. Carriage 33 may be constructed of a number of metal parts welded or otherwise secured together in a manner very similar to upper carriage 32, and is guided for only upward and downward movement relative to and along the column structure 31 by rollers 100 mounted to the body of the carriage and engaging the front, rear and sides of tracks 49.

Carriages 32 and 33 are attached together for movement upwardly and downwardly in unison by two parallel vertical rods 101 (FIGS. 6 and 7) bolted or otherwise secured at their upper and lower ends to the two carriages. These arms thus form one of the sides of the parallelogram mechanism 35, with two additional sides of that mechanism being formed by the two parallel swinging arms 36 and 37, and with the fourth side being formed by another rigid vertical rod 102 attached at its upper and lower ends to the extremities of arms 36 and 37 respectively by pivotal connections 103 and 203 whose axes are horizontal and parallel to axes 94 and 98. The bodies 104 and 105 of the upper and lower pipe holding units 38 and 39 are rigidly attached to the upper and lower ends respectively of vertical rod 102, to always be maintained by that rod in directly horizontal condition, in which the vertical gripping axes of the pipe holding units are directly vertical and aligned with one another to receive and grip a directly vertical pipe in all positions to which the arms 36 and 37 and the remainder of the parallelogram mechanism can swing.

The interconnected carriages 32 and 33 and the parallelogram mechanism 35 and other parts connected thereto are actuable upwardly and downwardly by two vertical piston and cylinder mechanisms 106 (see FIG. 7), whose cylinders 107 may be connected rigidly to carriage 32, as by attachment to flanges 132 projecting laterally from the carriage, and whose pistons may be connected at their upper ends 206 to member 50 at the upper end of the column structure. Such upward and downward movement of the parallelogram mechanism also effects similar upward and downward movement of the operator cab 40 and pipe connecting and disconnecting assembly 41.

Figure 9:
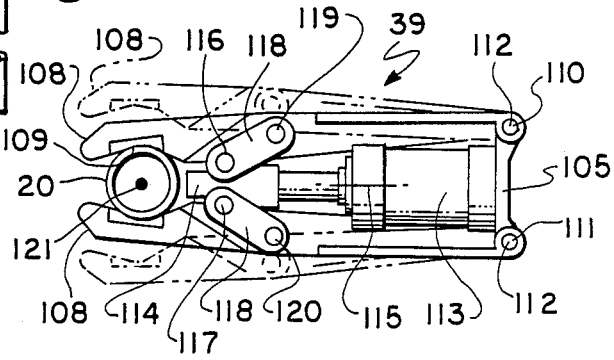

Lower pipe holding unit 39 is adapted to tightly grip stand 23 in a manner both retaining it against rotation and supporting the stand for lifting movement by unit 39. For this purpose, unit 39 has two jaws 108 (FIG. 9) carrying gripping dies 109 provided with gripping shoulders or teeth which extend both vertically and horizontally to restrain rotary movement of the pipe and also support the weight of the entire pipe stand from unit 39. The two jaws 108 of pipe holding unit 39 are elongated and have their inner ends connected at 110 and 111 to the body 105 of unit 39 for swinging movement about two parallel vertical axes 112 between the full line gripping positions of FIG. 9 and the broken line open positions of that figure. A piston and cylinder mechanism 113 for actuating the arms has its cylinder rigidly attached to body 105 and has its piston connected to a member 114 to actuate that member along a horizontal axis 115. Member 114 is pivotally connected at 116 and 117 to two links 118, which are in turn pivotally connected at 119 and 120 to arms or jaws 108, in a relation swinging the jaws toward and away from one another in response to axial movement of the piston within unit 113. Vertical rod 102 holds body 105 in a position in which the axes 112 of pivotal connections 110 and 111 of jaws 108 extend directly vertically, and the axis 121 of gripping jaws 108 and of a pipe held thereby is directly vertical and is always aligned with the pipe gripping axis of the upper pipe holding unit 38. This common axis 121 of the two pipe gripping units 38 and 39 is also aligned with the axes of spinner 42 and torque wrench 43 in the FIG. 1 position of the parts.

Figure 8:
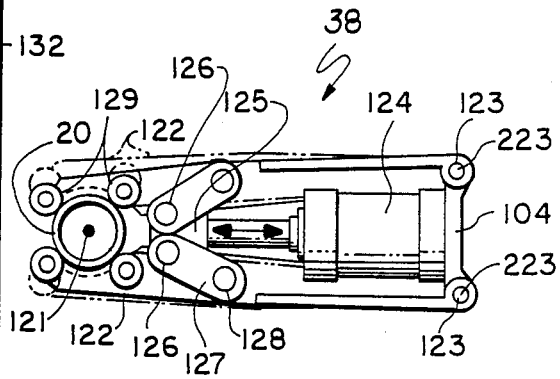
FIGS. 8 and 9 are enlarged horizontal sections taken on lines 8—8 and 9—9 respectively of FIG. 6, and showing the upper and lower pipe gripping units of the machine.

The upper pipe holding unit (FIG. 8) is similar to lower unit 39, but serves only to locate or center the engaged portion of the pipe, while not preventing rotation of the pipe. Unit 38 has two arms 122 connected pivotally at 123 to the body 104 of unit 38 and to the cylinder of a piston and cylinder mechanism 124 to mount the arms for opening and closing movement between the full line and broken positions of FIG. 8. A member 125 actuated by the piston of mechanism 124 is pivotally connected at 126 to a pair of links 127 whose opposite ends are pivoted at 128 to arms 122, to open and close the arms upon axial movement of the piston. Jaw arms 122 carry two pairs of rollers 129 which engage the pipe and turn about vertical axes parallel to the axis of the pipe to enable free rotation of the pipe about axis 121. In the closed position, rollers 129 engage and closely confine the pipe to maintain it in the centered directly vertically extending condition with respect to axis 121, while in the open position of arms 122 the rollers are far enough apart to allow the pipe holding unit to move onto and off of the pipe. It will of course be understood that all of the pivotal and rotary axes of the linkages of FIGS. 8 and 9 extend directly vertically and parallel to one another to attain the discussed type of operation.

The racking board 24 (FIG. 4) includes two structures 130 and 131 at opposite sides of the central portion 80 of the racking board, and each having a series of parallel horizontal fingers 132 spaced apart far enough to receive within the guideway 133 formed between each pair of successive fingers the upper ends of a row of pipe stands. The passages or guideways 133 between the various fingers have their longitudinal axes 134 extending directly perpendicular to the previously mentioned radial plane 60 which contains the axes 160 and 84 of horizontal movement of the synchronized lower and upper column actuating mechanisms defining the direction of retracting movement of the column structure and a carried pipe. The pipes are retained within the guideways or passages 133 by a series of segmentally formed retaining bars 135 actuated by motors 136 under the control of the operator. The preferred construction and manner of operation of these retaining bars have been disclosed in copending U.S. patent application Ser. No. 06/727,724 filed Apr. 26, 1985, now U.S. Pat. No. 4,709,766 entitled "Well Pipe Handling Machine". Two or more of the pipe receiving guideways **133*a* at the left ends of the two sections 130 and 131 as viewed in FIG. 4** may be somewhat wider than the other guideways to receive drill collars, of a greater diameter than the other sections of a drill string.

The lower vertically movable carriage 34 carried by column structure 31 includes two similar parallel vertically extending rigid frame members 137 which may take the form of hollow tubular elements of square horizontal section. These members 137 extend vertically along the rear sides of tracks 49, in close proximity thereto, and rotatably carry rollers 138 engaging the back sides of the tracks. The upper ends of members 137 may be bolted or otherwise attached rigidly to a pair of spaced parallel essentially triangular plates 139, and be rigidly interconnected by a frame structure 140 extending transversely between plates 139. Similar plates 141 may be connected to the lower ends of members 137, with those plates and the lower ends of members 137 being rigidly connected together by a suitable lower frame structure 142, typically including a cross-piece 242 (FIG. 15) at the front of plates 141, a rear plate 143 extending between the back sides of the lower portions of members 137, and two parallel members 169 perpendicular to cross-piece 142, with all of these elements being connected rigidly together as by welding. Rollers 144 mounted rotatably to carriage 34 engage the front sides of tracks 49, while rollers 145 appropriately attached to the carriage engage outer sides of the tracks, to thus effectively maintain carriage 34 in directly vertical condition and guide it for only directly vertical movement along column structure 31.

Carriage 34 is connected to carriage 33 for movement upwardly and downwardly therewith, and for powered actuation upwardly and downwardly relative to carriages 32 and 33. For this purpose, two parallel vertically elongated cylinders 143 (FIGS. 3, 6 and 6A) are connected rigidly to carriage 33, and contain pistons whose piston rods are connected at their lower ends 144 to the upper end of carriage 34. Thus, so long as hydraulic fluid is neither supplied to nor withdrawn from cylinders 143, the lower carriage 34 and connected parts will be retained by cylinders 143 and their pistons in fixed positions relative to upper carriages 32 and 33, and will therefore move upwardly and downwardly exactly in unison with carriages 32 and 33 and the parallelogram mechanism and a supported pipe. If fluid is introduced under pressure into either the upper or lower end of cylinders 143 (under the control of an operator in cab 40), the carriage 34 and carried parts will be actuated upwardly and downwardly relative to the parallelogram mechanism and carriages 32 and 33 as desired by the operator.

The control cab 40 takes the form of a hollow compartment or chamber within which an operator may sit on a seat 146 (FIG. 6) at a location to actuate controls 1 47. The spinner 42 and torque wrench 43 are located at the lower end of this control station, at a location permitting an operator to view the spinner and torque wrench and a pipe engaged thereby through a transparent window 148 located in the lower front portion of the cab. He can also view other portions of the mechanism through windows 149 in the upper portion of the cab, and can view video monitors 150 located within the cab and receiving signals from video cameras at different locations on the machine, preferably including two cameras 151 and 152 carried by the upper and lower pipe holding units 38 and 39 to enable an operator at all times to view the pipe gripping portions of units 39 and 40 on the monitors. The cab 40 may be rigidly secured to the body of carriage 34 in any convenient manner, as by bolting or other attachment of the cab to vertical members 137 of the carriage, and/or to plates 139 or 141, and/or to upper structure 140 or lower structure 142 of the carriage.

Figure 10:
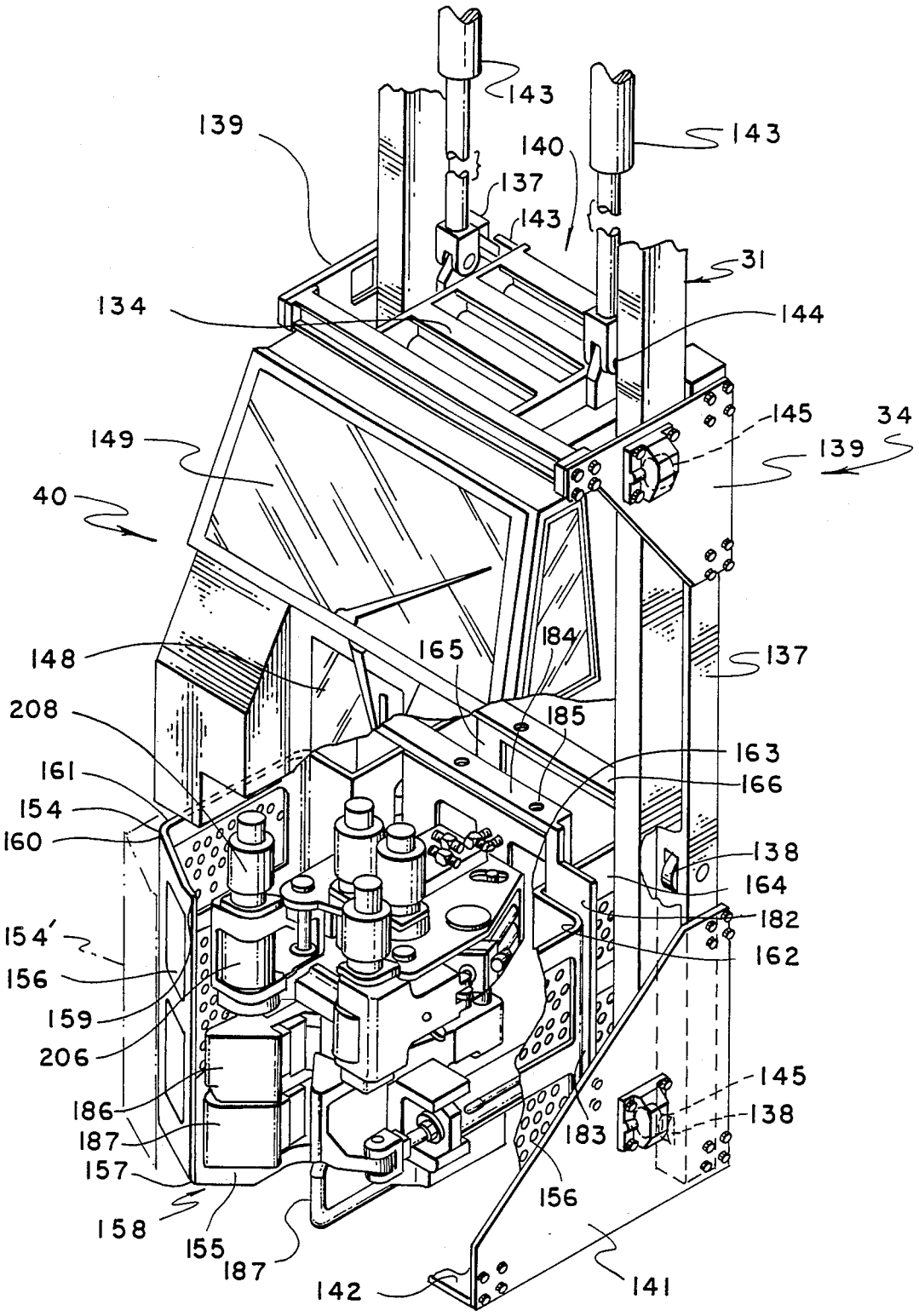
FIG. 10 is an enlarged fragmentary perspective view, partially broken away, of the control station or cab and the pipe connecting and disconnecting assembly.

The spinner 42 and torque wrench 43 of the pipe connecting and disconnecting assembly 41 are mounted within an inner carriage or container 154 (FIG. 10) which is carried by carriage 34 and mounted for horizontal shifting movement relative thereto with the spinner and torque wrench between the full line and broken line positions of FIG. 10. In the broken line position 154' of inner carriage 154, the spinner and torque wrench are shifted outwardly relative to and away from column structure 31 and cab 40, to the broken line positions 42' and 43' of FIG. 6A, to enable use of the spinner and torque wrench in the manner illustrated in FIG. 18 for engaging a single length of pipe rather than a three length stand.

Carriage 154 includes a rigid horizontal bottom plate 155 (FIGS. 6A and 10) on which torque wrench 43 is supported in an essentially fixed position relative to plate 155, and to which the torque wrench is connected for horizontal shifting movement with the plate 155. At its opposite sides, the horizontally shiftable carriage 154 includes two protective screens 156 which are connected rigidly at their lower edges 157 to the opposite side edges of horizontal bottom plate 155 of carriage 154, and which project upwardly from plate 155 at opposite sides of the spinner and torque wrench as seen in FIGS. 10 to 14, while leaving a gap 158 between forward edges of the screen through which a vertical well pipe can pass into and out of engagement with the spinner and torque wrench. To define the horizontal cross sectional configuration of these two screens 156 somewhat more specifically, the two screens in extending rearwardly from their forward edges 159 at gap 158 (see FIG. 14) may first flare progressively apart to locations 160, then extend rearwardly parallel to one another at 161 to locations 162 at which they may extend inwardly toward one another and in a common vertical plane to the locations 163, from which the screens may be turned through 90° to extend parallel to one another at 164 to their rear edges 165 at which they may be interconnected by a cross piece 166. This entire structure and the contained spinner and torque wrench are mounted for the discussed horizontal shifting movement by engagement of the horizontal undersurface 167 (FIGS. 6A and 15A) of bottom plate 155 of carriage 154 with the upper surfaces of four support rollers 168 carried rotatably by the lower rigid framework 142 of carriage 34. The two members 169 of lower framework 142 are rigidly connected at their back ends 170 to the vertically extending back plate 143 of carriage 34, and near their forward ends to the transverse frame member 242. The central vertical plane 171 of the spinner and torque wrench, which coincides with plane 60 of FIG. 5 in the FIG. 1 position of the machine, is midway between and parallel to the two roller mounting members 169, and defines the direction of horizontal shifting movement of the spinner and torque wrench and their enclosing carriage 154. Members 169 may be formed of hollow square tubing, with the rollers 168 being mounted rotatably thereto by shafts 172 extending across the interior of the square tubes 169, and with the upper surfaces of the rollers projecting upwardly above the upper surfaces of tubes 169 as seen in FIG. 15A. The previously mentioned rollers 144 for engaging the front sides of vertical tracks 49 of column structure 31 may also be mounted rotatably to members 169, by roller mounting shafts 173 projecting laterally from members 169. Carriage 154 is power actuated horizontally between the full line and broken line positions of FIGS. 6A and 10 by a piston and cylinder mechanism 174 (see FIGS. 6A and 15), including a cylinder 175 which is received at the underside of plate 155 of carriage 154 (FIG. 6A) and is attached rigidly to that plate by bolts 176 extending through openings in mounting flanges 177 at opposite ends of the cylinder. The piston within cylinder 175 has a rod 178 projecting from both ends of the cylinder, and connected at its opposite ends 179 and 180 rigidly to members 242 and 143 of carriage 34. The piston rod 178 is thus fixed relative to carriage 34, so that delivery of pressurized hydraulic fluid to either end of the cylinder 175 will cause horizontal movement along a horizontal axis 187 in plane 171 of cylinder 175 and the connected plate 155 and the remainder of carriage 154 and its contained spinner and torque wrench.

The connection of cab 40 to the body of vertically movable carriage 34 may be enhanced by provision of a support frame 182 (FIG. 10), which extends about horizontally shiftable carriage 154 and is connected at its lower end to the bottom frame structure 142 of carriage 34 and at its upper end to the underside of cab 40. More particularly, frame 182 may have two portions 183 connected at their lower ends in any appropriate manner to the bottom frame structure 142 of carriage 34 and projecting upwardly at opposite sides of the rear reduced width portion 164 of the screen structure and carrying a cross piece 184 at their upper ends received at the underside of the cab and secured rigidly to the cab in supporting relation by bolts extending upwardly through openings 185 in portion 184 and connected to the cab. As will be understood, the horizontally shiftable inner carriage 154 containing the spinner and torque wrench moves inwardly and outwardly relative to this cab supporting frame 182.

Figure 13:
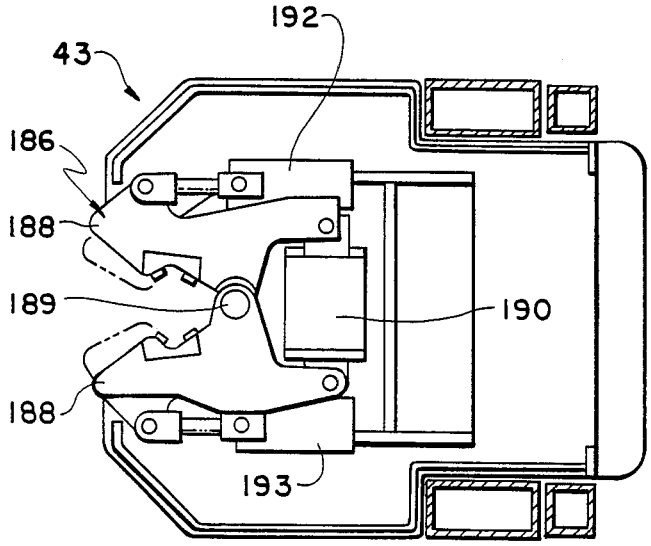

The torque wrench 43 may be of essentially conventional construction, including an upper section 186 (FIGS. 6A and 10) for engaging an upper one of two interconnected pipe joint ends, and a lower section 187 for engaging the lower of the two connected joint ends. As seen in FIG. 13, the upper section 186 includes two gripping jaws 188 which are connected pivotally together by a vertical hinge pin 189 for actuation of their left ends as viewed in FIG. 13 toward and away from one another and between the broken line gripping position of that figure and the full line open position. A piston and cylinder mechanism 190 received between the inner ends of the jaw levers power actuates the jaws between their gripping and released conditions. In their open conditions, the jaws are far enough apart to allow the torque wrench to move between a position about the pipe and a position laterally offset therefrom. The lower section 187 of the torque wrench is essentially the same as upper section 186, as discussed above, including two jaws similar to jaws 188 interconnected by the same hinge pin 189 as the upper jaws for pivotal actuation between gripping and released conditions by a second piston and cylinder mechanism 191. After the torque wrench has been positioned at one of the joints of the pipe string, section 186 of the torque wrench grips the lower end of one pipe section and section 187 of the torque wrench engages the upper end of a second pipe section. The two sections of the torque wrench can then be turned relative to one another about vertical axis 17 of the pipes to either break or make a threaded connection between the pipes. To attain this relative rotation, the torque wrench includes two additional piston and cylinder mechanisms 192 and 193, one of which has its cylinder connected to upper section 186 of the torque wrench and its piston connected to the lower section 187 of the torque wrench, and the other of which has its cylinder and piston connected in reverse to the two sections of the torque wrench, so that the piston and cylinder mechanisms 192 and 193 can power rotate the two sections of the torque wrench in either direction relative to one another and about the axis of the gripped pipe. The two sections 186 and 187 of the torque wrench are retained against horizontal displacement relative to plate 155, other than the discussed opening and closing movement, by extension of hinge pin 189 downwardly into an opening 289 in plate 155 (see FIG. 14). Structure 196 above the torque wrench is engageable therewith to prevent upward movement of the torque wrench and thus retain pin 189 in opening 289.

Figure 6A:
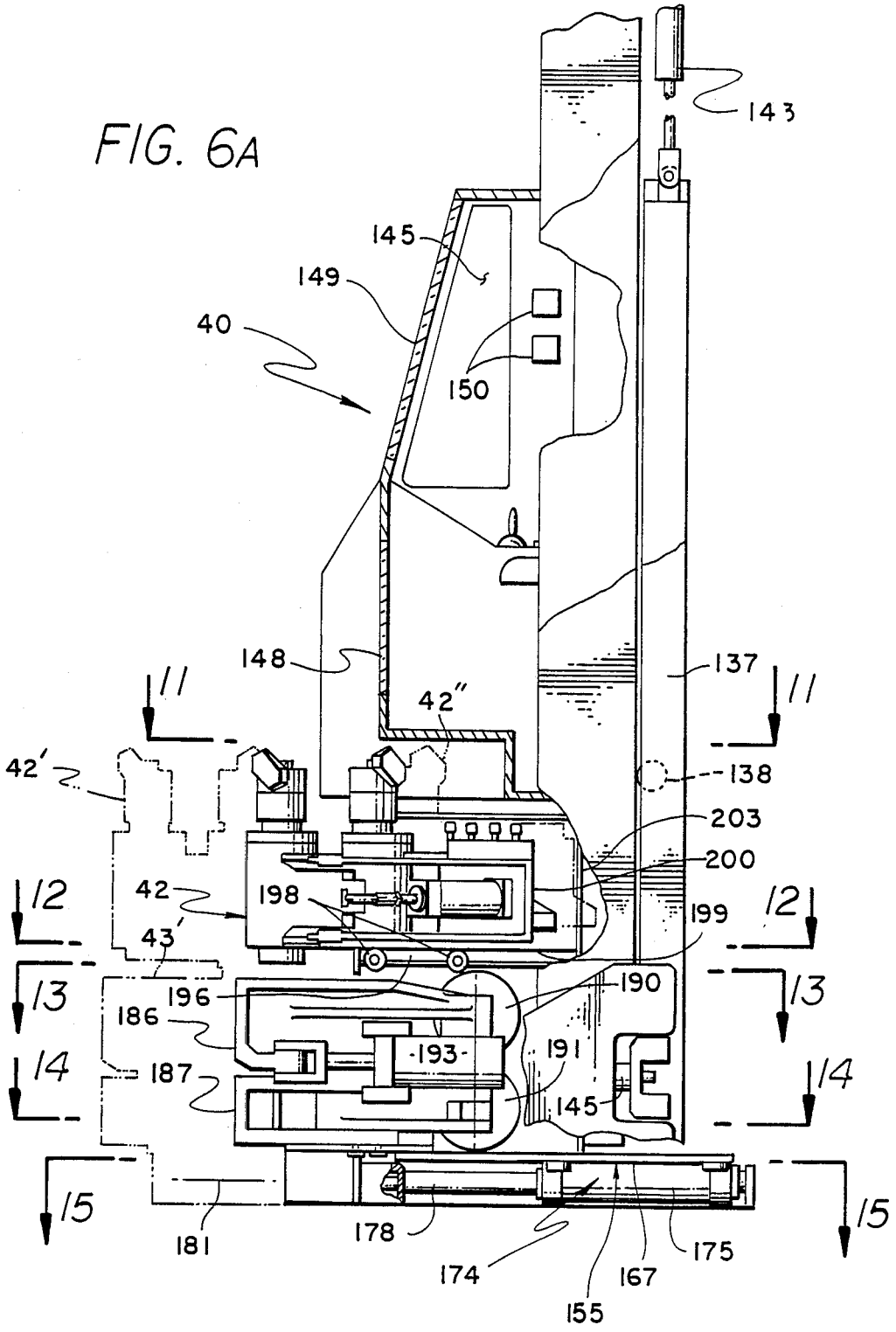
FIG. 6A is a view similar to the lower portion of FIG. 6, and showing some of the parts of the machine partially in elevation.

In addition to the above discussed bodily horizontal shifting movement of inner carriage 154 and the contained spinner and torque wrench as an assembly, the spinner is also mounted for independent horizontal shifting movement within the carriage 154 and relative to that carriage and the torque wrench from the full line position of the spinner in FIG. 6A to a retracted position of the spinner represented at 42" in that figure. This shifting movement is effected by providing carriage 154 with an essentially horizontally extending platform structure (FIGS. 6A and 12) above the torque wrench and at the underside of the spinner and relative to which the spinner is horizontally shiftable. The structure 196 may include two parallel channel shaped members 197 received at opposite sides of and parallel to vertical plane 171 and rotatably carrying four rollers 198 which may be similar to the previously mentioned rollers 168 at the bottom of carriage 34. These rollers 198, like the rollers 168, turn about parallel horizontal axes which are perpendicular to plane 171. The upper surfaces of rollers 198 lie in a common horizontal plane, and engage the horizontal undersurface 199 of a body 200 of spinner 42, to support the spinner for its horizontal shifting movement parallel to plane 171. The actuation of the spinner between its full line position of FIG. 6A and its position 42" can be effected by a piston and cylinder mechanism 201 (FIG. 12) similar to the previously discussed mechanism 174, with the cylinder of mechanism 201 being connected rigidly to the underside of body 200 of the spinner by bolts 301, and with the piston rod of mechanism 201 being connected rigidly to the frame of carriage 154 at 202. The roller support members 197 may be connected to the frame of carriage 154 in any convenient manner as by provision of a crosspiece 203 connected at its opposite ends to the frame of carriage 154 and extending across the underside of the spinner and attached rigidly to the forward ends of members 197, and by the further provision of a vertical plate 204 received at the back of the spinner and torque wrench and appropriately connected to the frame of carriage 154 and to the rear ends of members 197. The spinner 42 may be of conventional construction, as illustrated somewhat diagrammatically in FIG. 11, typically including two inner rollers 205 and two outer rollers 206 turning about four parallel vertical axes 207 and driven about those axes by individual motors 307 operating in unison with one another. The inner rollers 205 may be mounted to body 200 of the spinner at fixed locations relative thereto, to engage the inner side of the well pipe stand 23. The two outer rollers 206 may be mounted to a pair of arms 208 connected pivotally at 209 to body 200 of the spinner for swinging movement toward and away from one another between the full line positionsof FIG. 11 and the closed broken line positions of that figure. In the open positions of rollers 206, those rollers are spaced apart a distance greater than the diameter of the pipe to be held, and can thus be moved onto and off of the pipe, while in the closed broken line positions of FIG. 11 all four of the rollers engage the pipe to effectively rotate it about the vertical axis of the pipe upon energization of the driving motors. Arms 208 and the carried rollers 206 are actuable between their full line and broken line positions of FIG. 11 by piston and cylinder mechanisms 210 having their cylinders attached to body 200 of the spinner and having their pistons attached to the arms 208. When the spinner is in its position of FIG. 1 and the rollers are closed, the axis of the spinner and of a pipe held and driven by the spinner is exactly aligned vertically with the axes of pipe holding units 38 and 39 and with the axis of torque wrench 42. Motors 208 can drive the rollers in opposite directions, to turn the pipe in a direction to either screw two pipe sections together or threadedly detach them.

To describe a cycle of operation of the machine, assume that a drill string is initially in the well, and that it is desired to remove the string from the well and sequentially store a series of stands of pipe in the racking board area, with each stand including three lengths of pipe. During the drilling operation, column structure 31 and the carried parts are in the standby position represented in broken lines at 31' in FIG. 1. In that position, pipe handling units 38 and 39 and the spinner 42 and torque wrench 43 are all offset laterally from the pipe string to avoid interference with the drilling operation. Arms 36 and 37 are in positions closely proximate the column structure 31, in which pipe holding units 39 and 40 carried by the arms have their axes directly vertically aligned with the axes of spinner 42 and torque wrench 43, so that all of these units are located for simultaneous engagement with a stand of pipe when the column structure is actuated inwardly to the full line position of FIG. 1.

Before actuation of the machine from its standby position, elevator 25 is lowered downwardly about the upper end of the upper stand of pipe, and is then closed to grip that upper stand, after which the elevator is hoisted upwardly to lift the string to the FIG. 1 position. Slip assembly 15 is then set to engage the string just beneath the upper three section stand and support the string in the well. The elevator may then be remotely released and pulled upwardly away from the string. The operator then actuates a switch 212 in cab 40 to energize the motors 64 and 85 simultaneously and in unison to move the upper and lower ends of the column structure 31 leftwardly in precisely synchronized relation, and to the full line position of FIG. 1, in which the column structure remains directly vertical and the various vertically aligned units 38, 39, 42 and 43 are all received about the pipe stand. The jaws are of course all fully opened during such leftward movement of the column structure and carried parts to enable the different units 38, 39, 42 and 43 to move onto the pipe. The leftward end of the horizontal stroke of the column structure is precisely predetermined to accurately locate units 38, 39, 42 and 43 at exactly the well center line, with a stop limiting leftward movement in that position and thus avoiding any requirement for control of the positioning of the column by the operator. By actuation of another switch 213 in the control cab, the operator admits pressure fluid to piston and cylinder mechanisms 143 to move the cab and spinner and torque wrench upwardly or downwardly as necessary to bring the upper and lower sections of the torque wrench in proper engagement with the lower end of one pipe section and the upper end of another pipe section. If necessary, this movement may be supplemented by actuation of piston and cylinder mechanisms 106 to move all of the carriages upwardly and downwardly along the column structure. The operator then actuates an additional control valve or switch 214 in the cab to close the jaws of the torque wrench 41 and cause the torque wrench to forcibly rotate the joint end engaged by its upper section in a counterclockwise direction relative to the connected joint end engaged by its lower section in order to break the threaded connection at that location. The torque wrench may then be opened, after which the jaws of spinner 42 may be closed and the rollers of that spinner actuated by operation of another switch or switches 215 in the cab to cause the spinner to grip and rapidly rotate stand 23 relative to the remainder of the string to complete the disconnection of that stand from the string. At the time that the spinner is clamped on the pipe, the operator actuates another switch or valve 216 in the cab to close the jaws of upper pipe holding unit 38 in a manner enabling that unit to locate the upper portion of the stand and hold it in proper position while the spinner unscrews it from the upper end of the string. After the stand has been spun out, the operator actuates another switch 217 in the cab to close the jaws of the lower pipe holding unit 39 tightly enough on the stand to lift the stand, with vertical movement thereof being attained by actuating piston and cylinder mechanisxs 106 to pull the various carriages 32, 33 and 34 and connected parts upwardly far enough to move the lower end of the stand completely out of the upper box end of the remainder of the drill string.

With the stand elevated in this manner, the operator again actuates motors 46 and 86 in unison to retract the column structure and supported stand rightwardly toward the standby broken line position of FIG. 1, with the stand and connected parts elevated slightly above the FIG. 1 positions as discussed. During such retraction, the driller may begin lowering the elevator to pick up a next successive stand for removal by the machine. When the column structure 31 reaches the retracted broken line standby position of FIG. 1, or prior thereto if desired, the operator actuates a switch or valve 218 in the cab to energize rotary drive 47 at the bottom of the column structure, and pivot the column and carried parts including the suspended stand 23 through 90° about axis 48, to thus swing the stand to one side of the central portion 80 of the racking board assembly 24, as from the position represented at **23*a* in FIG. 4 to the position represented at 23*b* in that figure. The rightward travel of the column structure and carried parts is continued beyond the position 23*b* of the stand and until the stand reaches a position opposite a particular one of the pipe receiving guideways 172 in the racking board assembly within which that particular stand is to be located. For example, a first stand would normally be moved to a location opposite the guideway 172 which is located to the extreme right in FIG. 4, as to the position represented at 23*c* in that figure. The operator then releases the spinner and actuates a switch or valve 219 in the cab causing delivery of pressure fluid to piston and cylinder mechanisms 95 and 99 acting to swing arms 36 and 37 and the two pipe holding units 38 and 39 and the stand supported thereby to a position such as that represented in FIG. 3. During this swinging movement of the arms and the remainder of the parallelogram mechanism, the pipe moves downwardly as it moves laterally, and this movement continues until the stand reaches the end of the guideway 172 or contacts a previously inserted stand in that same guideway. When the stand reaches this proper location, the operator actuates a control 220 in the cab to move one of the bars 135 far enough to cross that particular guideway and lock the stand in position, after which the operator actuates piston and cylinder mechanisms 106 and 107 to lower carriages 32, 33 and 34 and the stand until the stand engages and is supported on the rig floor. The pipe holding units 38 and 39 are then opened remotely by the operator, piston and cylinder mechanisms 95 and 99 are actuated to swing the arms to their retracted positions adjacent the column structure 31, and the machine is brought back to the standby position by shifting the column leftwardly and pivoting the column structure about axis 48**. The procedure can be repeated for each succeeding stand until the entire string has been stored in the racking board assembly.

The procedure for returning the string back into the well is in most respects the reverse of that discussed above. The machine is first lined up with a selected one of the guideways 172 of the racking board assembly, and the arms 36 and 37 are then extended until pipe holding units 38 and 39 contact the stand and stop. These holding units are then closed and clamped about the stand, and the stand is raised off of the floor by elevation of the carriages and connected mechanism relative to the column structure. The arms and carried pipe stand are then swung to the fully retracted position adjacent the column, the torque wrench is vertically adjusted to a position in which its upper section engages the lower pin end of the stand, and the torque wrench and spinner are clamped on the stand. The machine is shifted horizontally as far as the standby position and rotated through 90° toward the well center line, where it may wait if the string is not yet in proper position for reception of the stand. After the string which is already in the hole has been lowered to a position near the rig floor and suspended by the slip mechanism 15, the operator can move column structure 31 and the supported stand to the well center line above the upper end of the drill string. Carriages 32, 33 and 34 can be lowered to move the stand downwardly into engagement with the upper end of the string, so that the spinner 42 can advance the stand rotatably into the upper box end of the string, and torque wrench 43 can be actuated to make up the connection tightly. An automatic interlock represented diagrammatically at 220 between the lower pipe holding unit 39 and spinner 43 acts to automatically release unit 39 from its clamped condition of engagement with the pipe stand when the spinner is energized, to thus allow the spinner to turn the pipe. The upper pipe holding unit 38 assists in locating a pipe during the spinning and torqueing operation. After the stand has been completely connected to the string, the operator can engage elevator 25 with the upper end of the added stand, and with all of the jaws of units 38, 39, 42 and 43 opened, column structure 41 and the carried parts can be retracted to the standby position and then shifted pivotally and horizontally to a position for picking up the next successive stand from the racking board assembly.

When the machine is to be utilized for handling single lengths of pipe rather than multiple length stands, the spinner and torque wrench are actuated outwardly away from the column structure and cab to the positions illustrated in FIG. 18, so that joints in the pipe string can be made and broken at a location far enough away from the column and cab to avoid interference with downward movement of a top drive unit 221 or other pipe suspending apparatus. To shift the spinner and torque wrench outwardly to the positions illustrated in FIG. 18, piston and cylinder mechanism 174 of FIG. 15 is supplied with fluid at its left end as viewed in that figure, to thereby shift cylinder 175 and carriage 154 containing spinner 42 and torque wrench 43 leftwardly, thus moving the spinner and torque wrench to the broken line positions 42' and 43' of FIG. 6A. The torque wrench and spinner may then be actuated to make or break a joint in the string as desired, and the single length of pipe can be moved to or from a storage location in conventional manner without use of the pipe holding units 38 and 39. When the machine is used in this FIG. 18 condition, the arms 36 and 37 are preferably swung to the fully retracted positions illustrated in FIG. 18, in which the arms and pipe holding units 38 and 39 are received directly laterally between the two tracks 49 of column structure 31, and are thus completely out of the path of the top drive unit and/or other apparatus.

FIG. 19 illustrates the manner in which the apparatus can be utilized for making and breaking a joint in a pipe string containing stabilizers 223 which are connected into the string and are of a diameter greater than the remainder of the string. The stabilizers may for example be connected between successive drill collars 23'', which may be of a diameter greater than the main portion of the drill string but not as great as the diameter of the stabilizers. When such stabilizers are present, the spinner is retracted horizontally relative to and out of vertical alignment with the torque wrench and pipe holding units 38 and 39, that is, to the retracted position illustrated in broken lines at 42'' in FIG. 6A, so that the upper and lower sections of the torque wrench can be engaged with the ends of two connected pipes to make or break a connection therebetween, while the spinner is retracted far enough to avoid contact with the stabilizer located just above those joint ends. In this event, the spinner cannot be utilized to turn the pipe before or after actuation by the torque wrench, but instead some other conventional means must be provided for that purpose. Otherwise, the operation of the machine in moving the pipe stands horizontally between the well axis and the racking board storage locations is the same as has been discussed above in connection with FIG. 1 and the other related figures.

While certain specific embodiments of the present invention have been disclosed as typical, the invention is of course not limited to these particular forms, but rather is applicable broadly to all such variations as fall within the scope of the appended claims.

I claim:

1. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

a torque wrench for making or breaking a connection between a vertical pipe section and said string;

a spinner for rotating a vertical pipe section;

connection means attaching said torque wrench and spinner to said column structure for movement with said column structure and pipe holding means and a vertical pipe carried thereby between said first and second positions of the column structure and adapted to locate said torque wrench and spinner in alignment with said axis of the well and string in said first position of the column structure and at a side of said axis in said second position of the column structure; and powered means for actuating said pipe holding means and said torque wrench and said spinner upwardly and downwardly in unison relative to said column structure, and for actuating said torque wrench and spinner upwardly and downwardly together relative to said pipe holding means.

2. A well pipe handling machine as recited in claim 1, in which said pipe holding means include two pipe holding units for engaging and holding a vertically extending pipe section at vertically spaced locations, said machine including a parallelogram mechanism mounting said two pipe holding units to said column structure and movable upwardly and downwardly relative thereto and including two similar swinging arms carrying said pipe holding units respectively and mounted for swinging movement in unison to move the pipe holding units and a carried pipe section generally horizontally toward and away from said column structure while retaining the pipe section in essentially vertical condition, said means for moving said support column structure including two synchronized powered drives for actuating upper and lower portions respectively of said column structure in unison toward and away from said axis, and means for pivoting said column structure about a vertical axis to face in different directions for moving a series of pipe sections to different storage locations.

3. A well pipe handling machine for use in a rig having a string of pipe extending vertically along an axis of a well, comprising:

a movable support;

pipe holding means carried by said support for movement therewith and adapted to hold a section of pipe in vertical condition;

means for moving said support carrying said pipe holding means and a pipe section held thereby between a first position in which the pipe holding means hold said pipe section in vertical condition in alignment with said axis of the well and a second position in which said pipe holding means locate said pipe section in vertical condition at a storage location offset from said axis;

a control station for holding an operator and which is carried by said support for movement therewith between said first and second positions of the support;

a torque wrench for making or breaking a connection between a vertical pipe section and said pipe string and which is carried by said support at essentially the lower end of said control station and for movement with the support between said first and second positions thereof; and a spinner for rotating a vertical pipe section and which is carried by said support for movement therewith between said first and second positions thereof and is located at essentially the lower end of said control station above said torque wrench.

4. A well pipe handling machine as recited in claim 3, including powered means carried by said support for actuating said control station and said torque wrench and said spinner upwardly and downwardly relative to said pipe holding means.

5. A well pipe handling machine as recited in claim 3, including powered means operable to move said pipe holding means and said control station and said torque wrench and said spinner upwardly and downwardly in unison relative to said support, and operable to move said control station and said torque wrench and said spinner upwardly and downwardly relative to said pipe holding means.

6. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well in essentially vertically extending condition and a second position in which said column structure remains in essentially vertically extending condition but is offset horizontally from said first position to move a pipe supported by said pipe holding means in vertical condition into or out of said rack;

pipe rotating means operable in said first position of the support column structure to engage and power rotate a pipe section extending vertically along said axis of the well;

connection means attaching said pipe rotating means to said column structure for movement with said column structure and pipe holding means and a vertical pipe section carried thereby between said first and second positions of the column structure and adapted to locate said pipe rotating means in alignment with said axis of the well and string in said first position of the column structure and at a side of said axis in said second position of the column structure; and means for shifting said pipe rotating means generally horizontally relative to said support column structure between an inner position for engaging and rotating a vertical pipe closely proximate said support column structure and an outer position for engaging and rotating a vertical pipe farther from said support column structure.

7. A well pipe holding machine as recited in claim 6, in which said pipe rotating means include a torque wrench for making or breaking a pipe connection and a spinner for rotating a pipe section, with said torque wrench and spinner both being actuable by said shifting means generally horizontally relative to the column structure between said inner and outer positions.

8. A well pipe handling machine as recited in claim 7, in which said torque wrench and spinner are movable horizontally relative to one another between positions of vertical alignment to engage a vertical well pipe and positions in which said spinner is retracted laterally relative to the torque wrench.

9. A well pipe handling machine as recited in claim 6, in which said connection means include a carriage mounted to said support column structure for movement upwardly and downwardly relative thereto, said pipe rotating means including a torque wrench and a spinner thereabove, said shifting means including a frame carried by said carriage for movement upwardly and downwardly therewith and mounted for horizontal shifting movement relative thereto and supporting said torque wrench and spinner for horizontal movement with the frame between said inner and outer positions of the pipe rotating means, there being additional means for moving said spinner generally horizontally relative to said frame and said torque wrench between a position of vertical alignment with the torque wrench and a laterally offset retracted position.

10. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

two pipe holding units carried by said support column structure at vertically spaced locations and adapted to engage a vertically extending section of pipe at vertically spaced locations and support the pipe in vertical condition;

two synchronized drive mechanisms acting against different portions of said support column structure at different vertically spaced locations and constructed to move said portions generally horizontally in correspondence with one another between a first position in which the support column structure extends essentially vertically and said pipe holding units support said pipe section in vertical condition in alignment with said axis of the well and a second position in which said support column structure remains in the same essentially vertically extending condition but is offset horizontally from said first position and said pipe holding units can move a pipe supported thereby in vertical condition into or out of said rack;

means for pivoting said column structure about a vertical axis to face in different directions in said second position of the column structure to move a series of pipes to different locations in the rack;

a carriage structure mounted to said column structure for movement upwardly and downwardly relative thereto;

a parallelogram mechanism mounting said two pipe holding units to said carriage structure for movement upwardly and downwardly therewith and including two similar swinging arms carrying said pipe holding units respectively and connected to said carriage structure for swinging movement in unison relative thereto to move the pipe holding units and a carried pipe generally horizontally toward and away from said column structure while retaining the pipe in essentially vertical condition;

a control station connected to said carriage structure for movement upwardly and downwardly therewith and adapted to hold an operator and having controls for operating the machine;

a torque wrench connected to said carriage structure for movement upwardly and downwardly therewith and located at essentially the lower end of said control station;

a spinner connected to said carriage structure for movement upwardly and downwardly therewith and with said parallelogram mechanism and said control station and said torque wrench and located at essentially the lower end of said control station and above the torque wrench; and means for actuating said control station and said torque wrench and said spinner upwardly and downwardly relative to said parallelogram mechanism.

11. A well pipe handling machine as recited in claim 10, including a frame structure connected to said control station for movement upwardly and downwardly therewith and supporting said torque wrench and spinner, and means for actuating said frame structure and the torque wrench and spinner generally horizontally relative to said control station and between an inner position for engaging and rotating a vertical pipe closely proximate said support column structure and an outer position for engaging and rotating a vertical pipe farther from said support column structure.

12. A well pipe handling machine as recited in claim 11, including means for shifting said spinner generally horizontally relative to said frame and said torque wrench between an active position of vertical alignment with the torque wrench and a retracted position laterally offset therefrom.

13. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

pipe connecting or disconnecting means carried by said column structure for movement therewith between said first and second positions and including a spinner for rotating a pipe section in alignment with said axis;

powered means for shifting said spinner upwardly and downwardly relative to said pipe holding means; and a control station which is adapted to hold an operator and has controls for operating the machine and which is carried by said column structure for movement therewith between said first and second positions and is movable upwardly and downwardly with said spinner relative to said pipe holding means.

14. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

pipe connecting or disconnecting means carried by said column structure for movement therewith between said first and second positions and including a spinner for rotating a pipe section in alignment with said axis;

powered means for shifting said spinner upwardly and downwardly relative to said pipe holding means;

said pipe connecting or disconnecting means including a torque wrench carried by said column structure for movement therewith between said first and second positions and located beneath said spinner and movable upwardly and downwardly with the spinner relative to said pipe holding means; and a control station which is adapted to hold an operator and has controls for operating the machine and which is carried by said column structure for movement therewith between said first and second positions and is movable upwardly and downwardly with said spinner and torque wrench relative to said pipe holding means.

15. A well pipe handling machine as recited in claim 14, including a parallelogram mechanism carried by said column structure for movement therewith between said first and second positions and for movement upwardly and downwardly relative thereto and having two similar swinging arms, said pipe holding means including two pipe holding units for engaging and holding a pipe section at vertically spaced locations and carried by said two arms respectively for swinging movement therewith to move the pipe holding units and a carried pipe section generally horizontally toward and away from said column structure, said means for moving said support column structure between said first and second positions including two synchronized powered drives for actuating upper and lower portions respectively of said column structure in unison toward and away from said axis, and means for pivoting said column structure about a vertical axis to face in different directions for moving a series of pipe sections to different storage locations.

16. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

a torque wrench for making or breaking a connection between a vertical pipe section and said string and carried by said column structure for movement therewith between said first and second positions;

a spinner for rotating a vertical pipe section and carried by said column structure for movement therewith between said first and second positions;

powered means for actuating said pipe holding means and said torque wrench and said spinner upwardly and downwardly in unison relative to said column structure, and for actuating said torque wrench and spinner upwardly and downwardly together relative to said pipe holding means; and a control station which is adapted to hold an operator and has controls for operating the machine and which is carried by said column structure for movement therewith between said first and second positions and is connected to said torque wrench and spinner for actuation upwardly and downwardly with the pipe holding means and torque wrench and spinner relative to said column structure, and for actuation upwardly and downwardly with the torque wrench and spinner relative to said pipe holding means.

17. A well pipe handling machine as recited in claim 16, including a parallelogram mechanism carried by said column structure for movement therewith between said first and second positions and for movement upwardly and downwardly relative to the column structure and including two similar arms mounted for swinging movement in unison relative to the column structure, said pipe holding means including two pipe holding units carried by said arms respectively for holding a pipe section at two vertically spaced locations, said means for moving said support column structure including two synchronized powered drives for actuating upper and lower portions of said column structure in unison toward and away from said axis, and means for pivoting said column structure about a vertical axis to face in different directions for moving a series of pipe sections to different storage locations.

18. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well in essentially vertically extending condition and a second position in which said column structure remains in essentially vertically extending condition but is offset horizontally from said first position to move a pipe supported by said pipe holding means in vertical condition into or out of said rack;

pipe rotating means carried by said support column structure for movement therewith between said first and second positions and operable in said first position of the support column structure to engage and power rotate a pipe section extending vertically along said axis of the well;

means for shifting said pipe rotating means generally horizontally relative to said support column structure between an inner position for engaging and rotating a vertical pipe closely proximate said support column structure and an outer position for engaging and rotating a vertical pipe farther from said support column structure; and a control station for holding an operator and having controls for operating the machine, said control station being carried by said support column structure for movement therewith between said first and second positions thereof.

19. A well pipe handling machine as recited in claim 18, in which said pipe rotating means include a torque wrench and a spinner, there being powered means for moving said pipe holding means and said torque wrench and said spinner and said control station upwardly and downwardly relative to said support column structure.

20. A well pipe handling machine as recited in claim 18, in which said pipe rotating means include a torque wrench and a spinner, there being powered means for moving said pipe holding means and said torque wrench and said spinner and said control station upwardly and downwardly relative to said support column structure, and for moving said torque wrench and spinner and said control station upwardly and downwardly relative to said pipe holding means.

21. A well pipe handling machine as recited in claim 20, including means for actuating said spinner generally horizontally relative to said torque wrench between a position of vertical alignment therewith and a laterally retracted position in which the spinner is offset to a side of the torque wrench.

22. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well in essentially vertically extending condition and a second position in which said column structure remains in essentially vertically extending condition but is offset horizontally from said first position to move a pipe supported by said pipe holding means in vertical condition into or out of said rack;

pipe rotating means carried by said support column structure for movement therewith between said first and second positions and operable in said first position of the support column structure to engage and power rotate a pipe section extending vertically along said axis of the well;

means for shifting said pipe rotating means generally horizontally relative to said support column structure between an inner position for engaging and rotating a vertical pipe closely proximate said support column structure and an outer position for engaging and rotating a vertical pipe farther from said support column structure;

a carriage mounted to said support column structure for movement upwardly and downwardly relative thereto;

said pipe rotating means including a torque wrench and a spinner thereabove;

said shifting means including a frame carried by said carriage for movement upwardly and downwardly therewith and mounted for horizontal shifting movement relative thereto and supporting said torque wrench and spinner for horizontal movement with the frame between said inner and outer positions of the pipe rotating means;

additional means for moving said spinner generally horizontally relative to said frame and said torque wrench between a position of vertical alignment with the torque wrench and a laterally offset retracted position;

a control station connected to said carriage for movement upwardly and downwardly therewith relative to said support column structure; and a parallelogram mechanism having two arms mounted to swing in unison and connected to said carriage for movement upwardly and downwardly with said carriage and frame and torque wrench and spinner and control station, said pipe holding means including two pipe holding units for engaging and holding a vertical pipe at spaced locations and carried by said two arms of the parallelogram mechanism for movement thereby toward and away from said support column structure.

23. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

a spinner operable to engage a vertical section of pipe in alignment with said string and rotate said pipe section relative to the string about said axis, to connect the pipe section to or disconnect it from the string;

a connection attaching said spinner to said column structure for movement with said column structure and pipe holding means and a vertical pipe section carried thereby between said first and second positions of the column structure and adapted to locate said spinner in alignment with said axis of the well and string in said first position of the column structure and at a side of said axis in said second position of the column structure;

powered means for shifting said spinner upwardly and downwardly relative to said pipe holding means; and a torque wrench carried by said column structure for movement therewith between said first and second positions and located beneath said spinner and movable upwardly and downwardly with the spinner relative to said pipe holding means.

24. A well pipe handling machine for use in a rig having a string of pipe extending vertically along an axis of a well and having a rack for receiving and holding a series of pipe sections from said string in essentially vertically extending condition, comprising:

a support column structure which extends essentially vertically and is movable generally horizontally to store said sections of pipe in said rack or retrieve them therefrom;

pipe holding means carried by said support column structure for movement therewith and adapted to hold a section of pipe in vertical condition during such movement;

means for moving said support column structure and said pipe holding means carried thereby and a vertical pipe section supported by said pipe holding means between a first position in which the support column structure extends essentially vertically and said pipe holding means support said pipe section in vertical condition in alignment with said axis of the well and a second position in which said column structure remains in essentially vertically extending condition but is offset horizontally from said first position and in which said pipe holding means can move a pipe section supported thereby in vertical condition into or out of said rack;

a spinner operable to engage a vertical section of pipe in alignment with said string and rotate said pipe section relative to the string about said axis, to connect the pipe section to or disconnect it from the string;

a connection attaching said spinner to said column structure for movement with said column structure and pipe holding means and a vertical pipe section carried thereby between said first and second positions of the column structure and adapted to locate said spinner in alignment with said axis of the well and string in said first position of the column structure and at a side of said axis in said second position of the column structure;

powered means for shifting said spinner upwardly and downwardly relative to said pipe holding means; and a parallelogram mechanism carried by said column structure for movement therewith between said first and second positions and for movment upwardly and downwardly relative thereto and having two similar swinging arms;

said pipe holding means including two pipe holding units for engaging and holding a pipe section at vertically spaced locations and carried by said two arms respectively for swinging movement therewith to move the pipe holding units and a carried pipe section generally horizontally toward and away from said column structure;

said means for moving said support column structure between said first and second positions including two synchronized powered drives for actuating upper and lower portions respectively of said column structure in unison toward and away from said axis, and means for pivoting said column structure about a vertical axis to face in different directions for moving a series of pipe sections to different storage locations.

* * * * *